US011083273B2

(12) United States Patent
Caulier et al.

(10) Patent No.: US 11,083,273 B2
(45) Date of Patent: Aug. 10, 2021

(54) DEVICE COMPRISING A SCREEN WITH ORIFICES OF VARIABLE SECTION

(71) Applicant: L'OREAL, Paris (FR)

(72) Inventors: Eric Caulier, Ferrieres (FR); Alexis Leonard, Saint-Ouen (FR); Audrey Thenin, Meudon (FR); Sophie Cloarec, Saint-Ouen (FR); Lise Bellavoine, Paris (FR)

(73) Assignee: L'OREAL, Paris (FR)

( * ) Notice: Subject to any disclaimer, the term of this patent is extended or adjusted under 35 U.S.C. 154(b) by 430 days.

(21) Appl. No.: 15/510,032

(22) PCT Filed: Sep. 9, 2015

(86) PCT No.: PCT/IB2015/056898

§ 371 (c)(1),
(2) Date: Mar. 9, 2017

(87) PCT Pub. No.: WO2016/038546

PCT Pub. Date: Mar. 17, 2016

(65) Prior Publication Data

US 2018/0228266 A1 Aug. 16, 2018

(30) Foreign Application Priority Data

Sep. 9, 2014 (FR) ..... 1458436

(51) Int. Cl.
*A45D 33/00* (2006.01)
*A45D 33/02* (2006.01)

(52) U.S. Cl.
CPC ..... *A45D 33/003* (2013.01); *A45D 33/006* (2013.01); *A45D 33/02* (2013.01)

(58) Field of Classification Search
CPC ..... A45D 33/033; A45D 33/006; A45D 33/02
See application file for complete search history.

(56) References Cited

U.S. PATENT DOCUMENTS 1,878,924 A * 9/1932 Will ..... A45D 33/003 220/568
2,601,940 A * 7/1952 Marcellus ..... A45D 33/02 222/205
2003/0024545 A1 2/2003 Delage
2004/0120753 A1* 6/2004 Gieux ..... A45D 33/02 401/200

(Continued)

FOREIGN PATENT DOCUMENTS

CN 202664613 U 1/2013
EP 1 277 418 A1 1/2003

(Continued)

OTHER PUBLICATIONS

Apr. 7, 2016 International Search Report issued in International Patent Application No. PCT/I132015/056898.

*Primary Examiner* — Nicholas D Lucchesi
(74) *Attorney, Agent, or Firm* — Oliff PLC

(57) ABSTRACT

Packaging and application device, including: a container containing a product to be applied, a screen through which the product contained in the container exits, the screen having dispensing orifices with different sections, with at least three orifices of which the section varies in a strictly decreasing manner with distance from the centre of the screen.

21 Claims, 2 Drawing Sheets

(56) References Cited

U.S. PATENT DOCUMENTS

Figure 1:
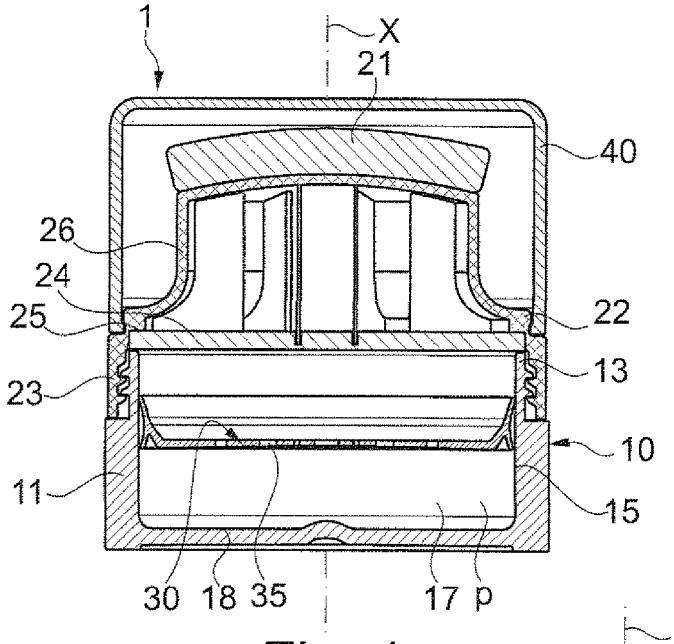

| | | | | |
|---|---|---|---|---|
| 2009/0188517 | A1* | 7/2009 | Thorpe | A45D 33/003 132/307 |
| 2009/0188518 | A1* | 7/2009 | Thorpe | A45D 33/003 132/307 |
| 2011/0048442 | A1 | 3/2011 | Pires et al. | |
| 2014/0069840 | A1* | 3/2014 | Park | A45D 33/003 206/525 |
| 2015/0257508 | A1* | 9/2015 | Shen | A45D 33/003 132/286 |
| 2017/0013939 | A1* | 1/2017 | Choi | A45D 40/0075 |
| 2019/0174898 | A1* | 6/2019 | Lu | A45D 40/00 |

FOREIGN PATENT DOCUMENTS

| | | | |
|---|---|---|---|
| FR | 2 838 618 | A1 | 10/2003 |
| JP | 2003-079425 | A | 3/2003 |
| JP | 2008-054702 | A | 3/2008 |
| WO | 2008/007832 | A1 | 1/2008 |

* cited by examiner

DEVICE COMPRISING A SCREEN WITH ORIFICES OF VARIABLE SECTION

The present invention relates to a device for packaging and dispensing a cosmetic product.

The invention relates more particularly to a device comprising a container containing a product to be applied and a screen through which the product contained in the container can exit.

Numerous devices of this type are known, with screens that have dispensing orifices through which the product exits, having various shapes and arrangements. The screen may or may not be a follower, that is to say may or may not descend in the container during the dispensing of the product.

Application CN202664613 discloses a device comprising a screen that has a central dispensing orifice of hexagonal section and a plurality of dispensing orifices disposed around this central orifice, each having an elongate shape and major axis that is oriented substantially radially.

The publication JP2003-79425 discloses a device in which the screen is constituted by a grating fixed to a support frame provided with tabs that can bend against the edge of the housing of the container containing the product when the screen descends in the container during the emptying thereof.

Application WO 2008/007832 A1 describes a device for pumping powder, comprising a curved powder-dispensing element that comprises orifices.

Also known is a casing comprising a screen in the form of a metal plate provided with orifices of circular section, the size of which increases towards the periphery of the screen. Such a distribution of the orifices aims to obtain uniform loading of the applicator, since the smaller size of the central offices is compensated by their being closer together.

There is a need to further improve packaging and application devices comprising a screen, in order in particular to obtain new makeup effects on application.

The invention achieves this objective by virtue of a device for packaging and applying a cosmetic product, comprising:

- a container containing the product to be applied,
- a screen through which the product contained in the container exits, the screen having dispensing orifices with different sections, with at least three orifices of which the section varies in a strictly decreasing manner with distance from the centre of the screen.

The invention makes it possible, if desired, to produce shading on applying the cosmetic product, by loading the application surface more greatly at the centre than at the periphery. It is thus possible to obtain on the application surface a variation in the quantity of product dispensed, which may be progressive, from more loaded to less loaded, at least in one region thereof, on moving towards the outside.

The orifices in the screen may each have a circular or non-circular, in particular polygonal, section.

All of the orifices in the screen may have a section which is a strictly decreasing function of the distance from the centre. In a variant, this relates only to some of the orifices in the screen, depending on the desired effects.

The ratio $S_{min}/S_{max}$ of the sections between that of the smallest orifice ($S_{mm}$) and that of the largest orifice ($S_{max}$) may vary between 1/5 and 1/1000, better still between 1/5 and 1/50.

The orifices in the screen may be disposed in concentric rings, in particular when they have a circular section. The number of orifices per ring may increase towards the periphery. The orifices may belong to successive rings in an angularly offset manner from one ring to the next.

In a variant, the orifices may be distributed randomly on the screen.

In a further variant, the orifices may be distributed in a geometric pattern or the like, for example in a star shape.

The orifices may each have a section of between 0.1 and 10 $mm^2$.

The spacing between two adjacent orifices, measured edge to edge, may be between 0.1 and 10 mm.

The total number of orifices may be between 1 and 1000.

The screen may comprise a central orifice through which part of the product contained in the container exits.

Preferably, the screen is movable with respect to the body of the container so as to follow the decrease in the level of product in the container. The screen may comprise a sealing means at its periphery.

The screen may rest on the product contained in the container.

The screen may have at least three concentric rings of orifices, better still at least five. The number of orifices per ring may strictly increase from one ring to the next on moving towards the periphery. In a variant, at least two consecutive rings have the same number of orifices, with the same section or different sections.

The screen may or may not be a follower.

In particular, when the screen is a follower, the screen may be produced by injection-moulding, in particular with a peripheral part comprising one or two sealing lips which press against the surface of the housing of the container containing the product.

Such a screen may comprise a rigid grating perforated by orifices for dispensing the product.

In a variant, the screen is produced without a peripheral part that presses in a sealed manner against the surface of the housing of the container containing the product.

The screen may be constituted by a film which is perforated and/or cut in order to have the desired shape. The dispensing orifices may be produced by laser. The dispensing orifices may have a constant section through their thickness. The thickness of the film may be sufficiently small for the film to be flexible. The thickness of the film is for example between 0.05 and 5 mm.

The screen may be able to come into contact with the product contained in the container.

The screen may comprise a central part and a peripheral part, the central part being substantially horizontal, in particular horizontal.

The area of the surface of the orifices that lies away from the application surface may, according to a variant of the invention, be greater than the area of the surface of the orifices that is oriented towards the application surface, in other words be greater than the section of the orifices.

The area of the surface of the orifices that lies away from the application surface may, according to another variant, be smaller than the area of the surface of the orifices that is oriented towards the application surface.

The film may have single-layered or multi-layered structure.

The film may be an elastic film.

The film may be made of a polyolefin material selected from PP, ABS, PE, PET, TPE, flexible materials starting from 25 sHA, aluminium film or some other deformable material.

The contour of the film may be notch-free, in particular circular, polygonal or ovoid. The contour of the film may have the same shape as that of the housing containing the product in cross section.

In a variant, the film has at its periphery at least one notch, better still a plurality of notches, which are preferably equally distributed. Such notches make it easier to deform the film at its periphery. Such deformation can make it easier to move the film towards the bottom of the container while the product is being used up.

The notches define between one another tabs which can be turned up against the wall of the housing.

The presence of the notches and tabs can make it possible to produce the film with an outside diameter very close to the inside diameter of the container in its top part. The risk of product passing between the periphery of the film and the wall of the container is thus minimized.

The packaging and application device in particular does not have a spring.

The product contained in the container can be in the form of a free powder or a fluid.

A further subject of the invention is a packaging and application device, in particular as described above, comprising:

a container containing a product to be applied, a screen, mounted as a follower, through which the product contained in the container exits, the screen comprising a peripheral part comprising a sealing means which presses against an internal surface of the body of the container.

The packaging and application device may comprise one or more of the above-described features, taken independently or in combination.

In particular, the sealing means preferably comprises one or more sealing lip(s).

The sealing means is in particular constituted of one or more sealing lip(s).

The sealing means may comprise at least one sealing lip that is oriented towards the product to be applied contained in the container, in other words towards the bottom of the container, in particular be constituted of a sealing lip that is oriented towards the product to be applied contained in the container.

The sealing means may comprise at least one sealing lip that is oriented away from the product to be applied contained in the container, in other words away from the bottom of the container, in particular be constituted of a sealing lip that is oriented away from the product to be applied contained in the container.

The sealing means may comprise a sealing lip that is oriented towards the product to be applied contained in the container and a sealing lip that is oriented away from the product to be applied contained in the container, in particular be constituted of a sealing lip that is oriented towards the product to be applied contained in the container and of a sealing lip that is oriented away from the product to be applied contained in the container.

The sealing lip(s) make it possible to improve the hermetic sealing of the contact zone between the screen and the internal surface of the body of the container. They make it possible in particular to limit or even avoid leaks of product at the periphery of the screen. This makes it possible to limit the formation of cakes of product on the applicator and the loading of product on the applicator at an undesired location.

The sealing lip(s) ensure good stability of the follower screen. The sealing lip(s) also make it possible to scrape the product along the body of the container. They make it possible to guide the product towards the dispensing orifices and not towards the internal surface of the body of the container.

The screen is in particular produced by injection-moulding.

The sealing means is in particular moulded in one piece with the rest of the screen.

The sealing lip(s) are in particular annular.

The sealing lip(s) press in particular elastically against the internal surface of the body of the container.

The sealing means may comprise, and in particular be constituted of, an upper sealing lip and a lower sealing lip, the height of the upper lip being in particular greater than that of the lower lip.

The lower edge of the lower lip may be situated approximately at the same level along the axis of the container as the lower face of the wall of the screen.

The screen may define a cavity, above the wall of the screen and inside the upper lip, which has a rotationally symmetrical shape that widens towards the top and is in particular adapted to that of the applicator member of the applicator.

The sealing means may comprise, and in particular be constituted of, two sealing lips in line with one another.

The sealing lip(s) have in particular a rounded shape which is concave towards the internal surface of the body of the container.

A further subject of the invention is a makeup method comprising the steps of:

loading an applicator member of a device according to the invention with product, applying the product to a region to be treated of human keratin materials.

The applicator member may be loaded without being rotated with respect to the container, and applied to the skin in the manner of a pad.

When the orifices have a section that decreases towards the periphery, it is possible to load the application surface more greatly at its centre than at its periphery, and obtain shading on application.

Figure 2:
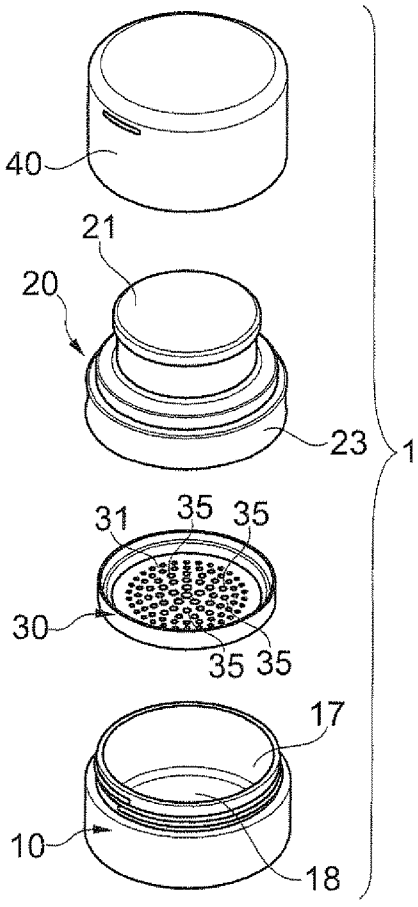
Figure 3:
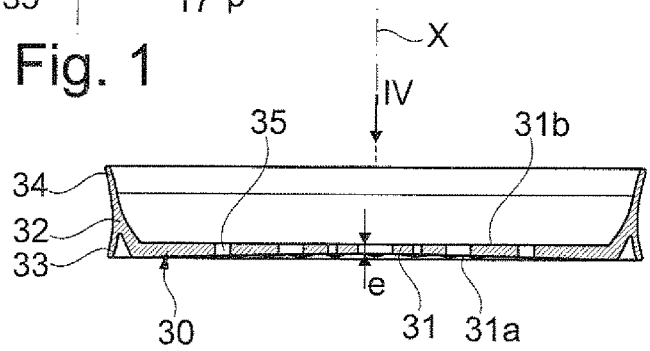
Figure 4:
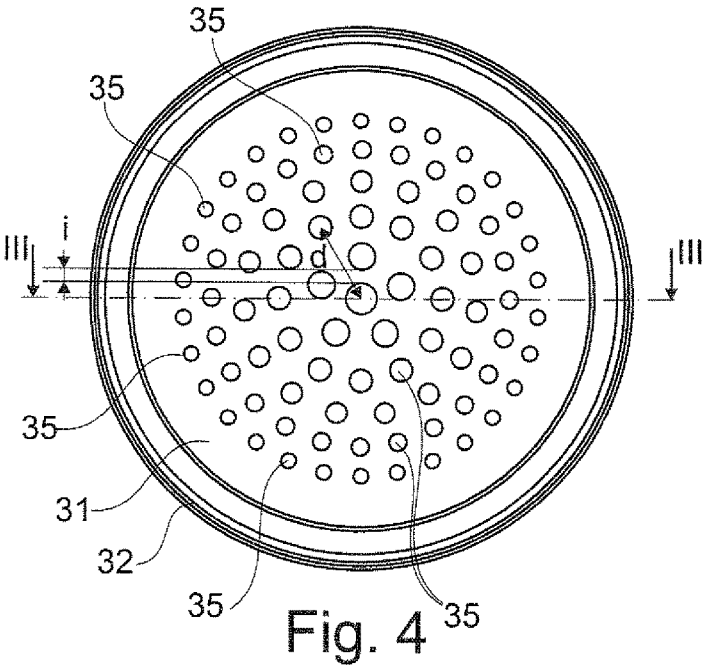
Figure 5:
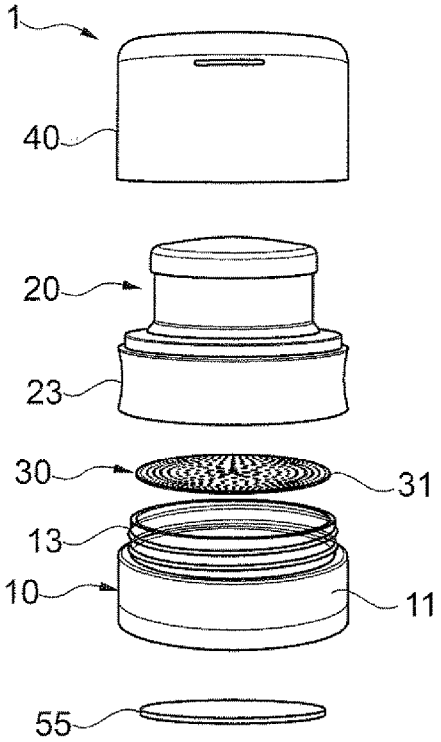
Figure 6:
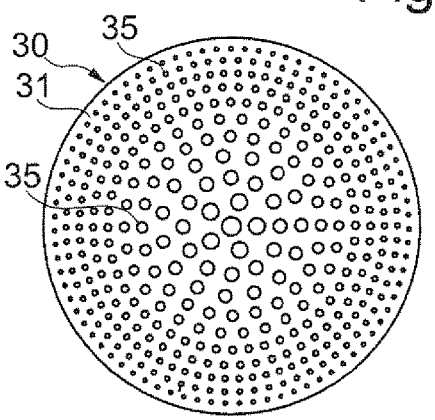
Figure 7:
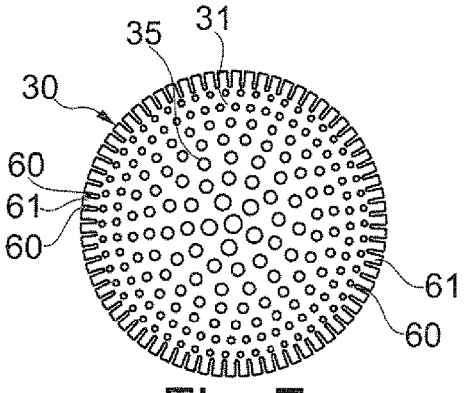

The invention may be better understood from reading the following detailed description of non-limiting implementation examples thereof and from examining the appended drawing, in which:

FIG. 1 shows, in axial section, an example of a device according to the invention, in the closed position, FIG. 2 is an exploded view of the device from FIG. 1, FIG. 3 shows the screen of the device from FIGS. 1 and 2 on its own, FIG. 4 is a top view along the arrow IV in FIG. 3, FIG. 5 is a view similar to FIG. 2 of a variant embodiment of the invention, FIG. 6 is a top view of the screen of the device from FIG. 5, FIG. 7 is a view similar to FIG. 6 of a variant embodiment, and FIGS. 8A to 8G illustrate further configurations of orifices in the screen.

The packaging and application device 1 shown in FIGS. 1 to 4 comprises a container 10 of axis X containing a cosmetic product P to be applied and an applicator 20 comprising an applicator member 21 for removing the product P and applying it to a surface to be treated, in particular to be made up, for example a region of skin.

The device 1 comprises a screen 30 which is movable in the body 11 of the container 10 along the axis X in order to accompany the drop in the level of product as the latter is removed.

The screen 30 rests against the product P, as can be seen in FIG. 1, being pushed towards the bottom of the container by the user each time product is removed.

The device 1 comprises a protective cap 40 which can be fixed, for example by snap-fastening, to a corresponding bulge 22 on the applicator 20, as is illustrated in FIG. 1.

The applicator 20 also comprises an internally threaded mounting skirt 23 that is designed to be screwed onto a threaded neck 13 that is present in the upper part of the body 11 of the container 10.

The applicator 20 may accommodate a seal 24 which, when the applicator is screwed onto the threaded neck 13, presses against the upper end edge of the latter. This seal 24 can be held at the bottom of the threaded skirt 23 and bear against an internal shoulder 25 of the body 26 of the applicator.

The screen 30 comprises a perforated wall 31, the thickness e of which measured at the centre of the screen 30 is for example between 0.05 and 2 mm, and a peripheral part 32 comprising two annular sealing lips 33 and 34 that are oriented downwards and upwards, respectively, and press elastically against the internal surface 15 of the body 11 of the container 10 defining the housing 17 containing the product P. The height of the upper lip 34 may be greater than that of the lower lip 33.

The screen 30 may define a cavity, above the grating 31 and inside the upper lip 34, which has a rotationally symmetrical shape that widens towards the top and is adapted to that of the applicator member 21 of the applicator. The elasticity of the sealing lips 33 and 34 allows them to bend slightly as the screen 30 descends in the container, the surface 15 having a slight taper and its diameter tending to decrease in the direction of the bottom 18 of the container. The housing 17 has a rotationally symmetrical overall shape of axis X.

The wall 31 of the screen 30 is perforated by a plurality of orifices 35 having sections which vary with the distance d of the orifices from the centre.

The distance d is measured for each orifice between the axis X and the centre of mass of the section of this orifice 35, as illustrated in FIG. 4.

The orifices 35 can be distributed in various manners over the wall 31 of the screen 30.

In the example in FIG. 4, the screen 30 comprises a central orifice and rings of concentric orifices, the orifices being equally distributed angularly about the axis X in each ring, the number of orifices being for example 5 for the first ring, and then 12 for the following ring, and then 15, 24 and 30 for the following rings.

The diameter of the central orifice is for example 2.5 mm. The diameter of the following orifices, with increasing distance from the central orifice, passes for example to 2.15, 1.83, 1.55, 1.29 and 1.06 mm respectively.

The gap i between the edges of the adjacent orifices in two successive rings, measured along a radius where all of the axes of the orifices are aligned, as illustrated in FIG. 4, is for example 1 mm.

FIG. 3 shows that the lower edge of the lip 33 is situated substantially at the same level, along the axis X, as the lower face 31*a* of the wall 31. The upper face 31*b* of the wall 31 may be substantially flat and perpendicular to the axis X, while the lower face 31*a* is for example slightly concave towards the product P.

Thus, the wall 31 may be narrower at the centre than at its periphery.

In order to use the device 1, the user takes off the protective cap 40, and then unscrews the applicator 20. The mounting skirt 23 of the applicator serves as a gripping member once the applicator 20 has been unscrewed. The user can then apply the applicator member 21 to the wall 31 of the screen 30 in order to load it with product. The user can simply apply the applicator member 21 to the wall 31 without moving the applicator other than towards and then away from the screen, this causing product to be deposited locally on the applicator member in the form of dots of product, in a quantity which depends on the section of the orifices.

In a variant, when removing product, the user can turn the applicator on itself about the axis X, this being able to have the effect of distributing the product over the surface of the applicator member in concentric loading zones, with a quantity of product which is greater at the centre than at the periphery.

The user can then dab his/her skin with the applicator thus loaded with product in order to create a deposition of product that is more loaded at the centre than at the periphery, giving the impression of shading. The user can blur the product thus deposited as much as required with the same applicator, by moving it over the skin, or with the aid of another applicator. Next, the user can put the applicator 20 back in place by screwing it onto the neck 13 and then fixing the cap 40.

In the variant in FIG. 5, the screen 30 only comprises the perforated wall 31, it then not having the sealing lips 33 and 34 from the example in FIGS. 1 to 4.

In the example in FIGS. 5 and 6, the screen 30 is constituted by a flexible film which rests on the product P in the container 10. The screen 30 can thus have a circular edge at its periphery, having for example a constant thickness.

In the example in FIGS. 5 and 6, the screen 30 comprises a central orifice 11 and concentric rings of orifices, with a diameter that decreases in the direction of the periphery, the orifices of the radially outermost ring each having for example a diameter of 0.1 mm, as opposed to a diameter of 3 mm for the central orifice.

The thickness of the film constituting the perforated wall of the screen is for example between 0.2 and 2 mm, better still between 0.2 and 1 mm. This film is for example made of a thermoplastic material selected from PP, ABS, PE, PET, TPE, flexible materials starting from 25 sHA, aluminium film or some other deformable material.

According to FIG. 5, it can be seen that a mirror 55 can be fixed to the wall defining the bottom of the container 10, on the outer side. In a variant, this mirror is absent.

The outside diameter of the screen 30, in the example in FIGS. 5 and 6, corresponds to the diameter of the bottom 18 of the housing 17 of the container holding the product, so as to allow the screen to descend as far as the bottom of the container as the product is consumed.

In the variant in FIG. 7, the screen 30 has at its periphery notches 60 which define between one another tabs 61 that can bend in order to allow the screen 30 to descend in the container. The outside diameter of the screen can in this case be greater than that of the bottom of the housing. The number of notches is for example greater than 50, better still than 60, for example equal to 70.

The length of a tab is for example between one and two times the spacing i between two successive rings of orifices, measured between the edges of adjacent orifices.

Figure 8A:
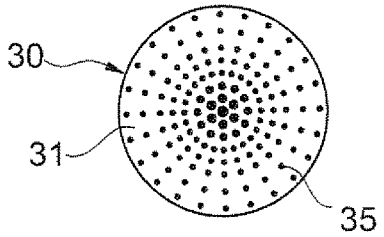
Figure 8B:
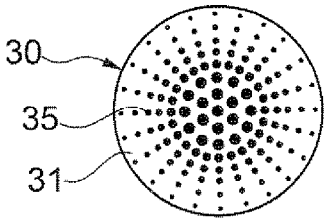

FIGS. 8A and 8B show further possibilities for arranging the orifices 35 on the wall 31 of the screen 30.

In the examples in FIGS. 4, 6 and 7, the diameter of the orifices 35 strictly decreases with increasing distance from the axis X.

In the example in FIG. 8A, it can be seen that the diameter of the orifices can decrease while being the same for at least two consecutive rings. In this case, the section of the orifices decreases incrementally from the centre. The same goes for the example of FIG. 8B. It is thus possible to have a plurality of concentric regions within which the dispensing orifices have the same section. The number of rings of orifices within each region varies for example from one to five.

Figure 8C:
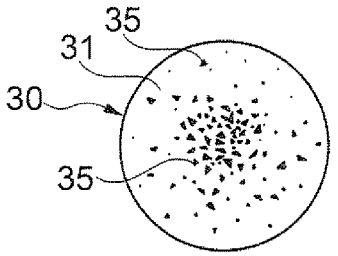

The example in FIG. 8C corresponds to an irregular distribution of the orifices 35 on the wall 31. There are for example orifices with a polygonal section, which are more numerous in a central region, which is not necessarily centred, as can be seen in FIG. 8C, the orifices 35 being less numerous at the periphery of the screen 30.

It is possible to find at least three orifices 35, the section of which decreases as a function of increasing distance from the central axis X of the screen, these orifices being able to be mixed with other orifices where the variation in the section as a function of the distance from the axis X is different.

In the example in FIG. 8C, the orifices have a polygonal section, in the form of a regular or irregular polygon, in particular a triangle, and at least some orifices can have a section with an elongate shape along a major axis which can be oriented radially or non-radially. The orientations of the major axes can be random.

Figure 8D:
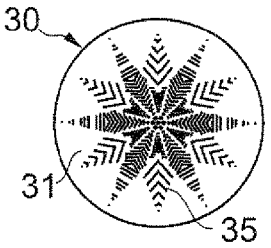

The possibility for the orifices 35 to have a non-circular section, for example in the form of a chevron, is illustrated in FIG. 8D, the set of orifices 35 being disposed for example in a star shape. Within one arm of the star, there are for example a plurality of consecutive orifices 35, the section of which decreases towards the periphery of the screen.

Figure 8E:
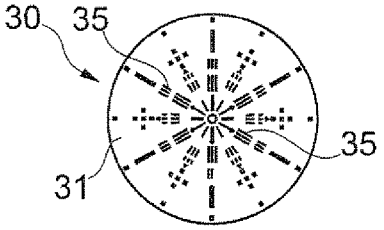

The possibility for the orifices 35 to have a non-circular section, for example in the form of slots, is illustrated in FIG. 8E. There may be a plurality of orifices which follow one another in the radial direction and which have decreasing sections.

Figure 8F:
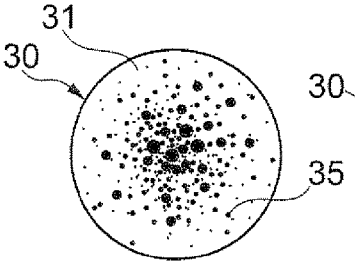

In the example in FIG. 8F, the orifices have a circular section, and it is possible to find at least three orifices with different sections, with a larger section for the orifice which is closest to the central axis and a smaller section for the one which is farthest therefrom.

Figure 8G:
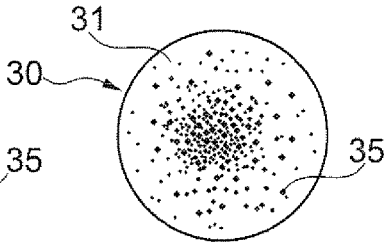

The example in FIG. 8G is similar to the one in FIG. 8C, the sections of the orifices being non-circular, for example star-shaped. In this example, it is possible to find at least three orifices with sections that decrease with increasing distance from the central axis X of the screen.

In the examples in FIGS. 8D and 8E, the orifices are organized in geometric patterns other than concentric rings. There may be an angular distribution of the orifices which is not regular about the axis X. The pattern which is formed by the orifices can be reproduced on the skin when the applicator is loaded without turning it relative to the container and applied to the skin like a pad.

The patterns in FIGS. 8F and 8G can give the impression of freckles and/or can be used to conceal skin defects without completely covering the skin.

Of course, the invention is not limited to the examples illustrated, and it is possible in particular to combine the characteristics of the examples illustrated with one another as parts of variants which are not illustrated.

Other arrangements of the orifices 35 are possible, with circular or non-circular sections. For example, in variants, the circular orifices in the examples in FIG. 6 or 7 are replaced by orifices with a non-circular, for example polygonal, section.

The invention claimed is:

1. Packaging and application device, comprising:

a container containing a product to be applied, a screen through which the product contained in the container exits, the screen comprising a wall having dispensing orifices with different sections, with at least three orifices of which the section varies in a strictly decreasing manner with distance from the centre of the screen, the ratio of the sections between that of the smallest orifice and that of the largest orifice varying from 1/5 to 1/1000, the screen resting on the product contained in the container and being movable with respect to a body of the container so as to follow a decrease in a level of product in the container, the screen comprising a peripheral part comprising a sealing means which presses against an internal surface of the body of the container, the sealing means comprises at least one sealing lip that is oriented towards the product to be applied contained in the container, the lower edge of the at least one sealing lip being situated substantially at the same level, along the axis X of the container, as the lower face of the wall of the screen.

2. Device according to claim 1, wherein the section of said at least three orifices decreases towards the periphery of the screen.

3. Device according to claim 1, wherein said orifices each have a circular section.

4. Device according to claim 1, wherein the orifices have a non-circular section.

5. Device according to claim 1, wherein all of the orifices in the screen have a section which is a strictly decreasing function of the distance from the centre.

6. Device according to claim 1, wherein the orifices in the screen are disposed in concentric rings.

7. Device according to claim 6, wherein the number of orifices per ring increases towards the periphery.

8. Device according to claim 6, wherein the orifices belong to successive rings in an angularly offset manner from one ring to the next.

9. Device according to claim 1, wherein the orifices are distributed randomly on the screen.

10. Device according to claim 1, wherein the orifices are distributed in a star-shaped pattern on the screen.

11. Device according to claim 1, wherein the total number of orifices is between 1 and 1000.

12. Device according to claim 1, wherein the screen comprises a sealing means at its periphery.

13. Device according to claim 1, wherein the orifices each have a section of between 0.1 and 10 $mm^2$.

14. Device according to claim 1, wherein the spacing between two adjacent orifices, measured edge to edge, is between 0.1 and 20 mm.

15. Device according to claim 1, the sealing means being molded in one piece with the rest of the screen.

16. Device according to claim 1, wherein the sealing means comprises at least one sealing lip that is oriented away from the product to be applied contained in the container.

17. Device according to claim 1, wherein the screen is produced by injection-moulding.

18. Device according to claim 1, wherein the ratio of the sections between that of the smallest orifice and that of the largest orifice varies from 1/5 to 1/50.

19. Device according to claim 1, wherein the screen has at its periphery a plurality of notches that define between one another tabs configured to bend and to allow the screen to descend in the container.

20. Device according to claim 19, wherein an outside diameter of the screen is greater than an inner diameter of a bottom of the container.

21. Makeup method, comprising the steps of:

loading an applicator member of a device according to claim 1 with product, applying the product to a region to be treated of human keratin materials.

* * * * *